US012570496B2

(12) United States Patent
Zimmers

(10) Patent No.: US 12,570,496 B2
(45) Date of Patent: Mar. 10, 2026

(54) MOBILE BARBED WIRE FENCE PULLING ASSEMBLY

(71) Applicant: Jeff Zimmers, Eureka, KS (US)

(72) Inventor: Jeff Zimmers, Eureka, KS (US)

( * ) Notice: Subject to any disclaimer, the term of this patent is extended or adjusted under 35 U.S.C. 154(b) by 352 days.

(21) Appl. No.: 18/375,718

(22) Filed: Oct. 2, 2023

(65) Prior Publication Data

US 2024/0076159 A1 Mar. 7, 2024

(51) Int. Cl.
*B65H 49/32* (2006.01)
*E04H 17/26* (2006.01)

(52) U.S. Cl.
CPC ..... *B65H 49/324* (2013.01); *E04H 17/266* (2013.01); *B65H 2515/31* (2013.01); *B65H 2701/363* (2013.01)

(58) Field of Classification Search
None
See application file for complete search history.

(56) References Cited

U.S. PATENT DOCUMENTS 2,789,778 A 4/1957 Zogg et al.
2,914,270 A 11/1959 Parker et al.
3,356,341 A 12/1967 Brown
3,722,861 A 3/1973 Anderson
4,775,114 A 10/1988 Farnsworth
5,042,737 A 8/1991 Sigle et al.
5,582,216 A * 12/1996 Smith ..... B21F 33/00 140/16
5,632,470 A * 5/1997 Leland ..... E04H 17/266 254/323
5,904,314 A * 5/1999 Babcock, Jr. ..... E04H 17/266 242/566

(Continued)

FOREIGN PATENT DOCUMENTS

WO WO 2009/025679 2/2007

OTHER PUBLICATIONS

"Barbed Wire Unwinding Machine: Cloturmatic RXB," rabaud.com. Accessed: May 4, 2023 https://www.rabaud.com/en/products/netting-and-barbed-wire-unwindingmachine/barbed-wire-unwinding-machine-cloturmatic-rxb.html.

(Continued)

*Primary Examiner* — William A. Rivera
(74) *Attorney, Agent, or Firm* — Kenneth H. Jack; Davis & Jack, L.L.C.

(57) ABSTRACT

A vehicle carriable barbed wire fence pulling assembly incorporating a trailer having a load bed; a plurality of spindles, each spindle being mounted upon the load bed, each spindle being adapted for receiving a barbed wire spool; a winch and traction cable combination overlying the load bed, the combination being adapted for, upon a longitudinal extension of the combination's traction cable from the load bed, pulling the cable oppositely longitudinally; an anchoring assembly attaching an oppositely longitudinal end of the winch and traction cable combination to the load bed, the anchoring assembly including an elastically deformable link adapted for oppositely longitudinally translating the cable pull; an electronic strain gauge fixedly attached to the elastically deformable link; a strain meter electrically connected to the electronic strain gauge, the strain meter being adapted for displaying a magnitude of the cable pull; and a hitch adapted for attaching the trailer to the vehicle.

15 Claims, 5 Drawing Sheets

(56) References Cited

U.S. PATENT DOCUMENTS

| | | | | |
|---|---|---|---|---|
| 6,065,714 | A * | 5/2000 | Fondacaro | E04H 17/266 242/594.6 |
| 6,860,471 | B2 | 3/2005 | Albritton | |
| 6,951,316 | B1 * | 10/2005 | Heidelberger | B65H 49/32 242/594.6 |
| 7,011,269 | B1 * | 3/2006 | Chouinard | E04H 17/266 242/594.6 |
| 7,195,193 | B2 | 3/2007 | Capps | |
| 7,264,195 | B2 | 9/2007 | Fletcher et al. | |
| 10,533,341 | B1 | 1/2020 | Hicks | |
| 10,837,196 | B2 | 11/2020 | Cowan | |
| 10,994,973 | B2 * | 5/2021 | Hubener | B66D 1/00 |
| 2004/0065767 | A1 * | 4/2004 | Parker | E04H 17/266 242/594.3 |
| 2005/0133776 | A1 * | 6/2005 | Capps | E04H 17/266 256/32 |
| 2008/0258003 | A1 * | 10/2008 | Foster | B65H 59/04 242/611 |
| 2011/0121125 | A1 | 5/2011 | Stow et al. | |
| 2012/0048988 | A1 * | 3/2012 | Pulver | B65H 49/32 242/557 |
| 2014/0048758 | A1 | 2/2014 | Oland | |
| 2022/0316235 | A1 * | 10/2022 | Brawner | E04H 17/127 |

OTHER PUBLICATIONS

"Barbwire Stretcher," ezgmfg.com. Accessed: May 4, 2023.

"Hydraulic Self Loading Wire Unwinder and Stretcher," wellscroft.com. Accessed: May 4, 2023. https://www.wellscroft.com/hydraulic-self-loading-wire-unwinder-and-stretcher.

Dan The Tool Man, "Homemade Barbed Wire Unroller Fencing Trailer," Sep. 5, 2020. https://www.youtube.com/watch?v=2su0HMQCWUk.

* cited by examiner

MOBILE BARBED WIRE FENCE PULLING ASSEMBLY

FIELD OF THE INVENTION

The instant invention relates to apparatus and assemblies adapted for assistance with construction and assembly of barbed wire fences. More particularly this invention relates to such assemblies which are mounted upon or carried by a mobile vehicle.

BACKGROUND OF THE INVENTION

Vehicle mounted assemblies adapted for simultaneously dispensing and deploying multiple strands of barbed wire during barbed wire fence construction are known. Such conventional assemblies commonly lack any structure, adaptation, or mechanism allowing an operator to properly tension the deployed strands of barbed wire during the fence construction process.

The instant inventive mobile barbed wire fence pulling assembly solves or ameliorates the problems, defects, and disadvantages of such conventional barbed wire deploying assemblies by mounting upon a barbed wire spool supporting frame specialized apparatus adapted to stretch deployed barbed wire strands while constantly gauging and displaying levels of tension applied to such strands.

OBJECT AND SUMMARY OF THE INVENTION

A first structural component of the instant inventive mobile barbed wire fence pulling assembly comprises a support frame. In a preferred embodiment, the support frame comprises a steel weldment which serves as a load bed of a wheeled trailer. Suitably, the support frame may comprise a weldment adapted for extension from a tractor's rear three point hitch assembly. Also suitably the support frame may alternatively comprise a weldment supported by a truck rear bumper receiver hitch assembly.

A further structural component of the instant inventive assembly comprises a plurality of spindles, each spindle being adapted for receiving a barbed wire spool. In a preferred embodiment, each of the spindles comprises a rotating base plate for support of the barbed wire spool in combination with a vertically extending axle shaft. In an alternative suitable embodiment the spindle may comprise a fixed shaft which extends through the barbed wire spool's axle channel. In the preferred embodiment, the axle shaft component of the spindle extends vertically upward from the support frame. In a suitable alternative configuration the spindles or axle shafts may extend substantially horizontally, such shafts horizontally orienting the barbed wire spools.

A further structural component of the instant inventive assembly comprises a winch and traction cable combination which is mounted in an overlying orientation with respect to the support frame. In a preferred embodiment, the winch and traction cable combination is adapted for, upon a longitudinal extension of the traction cable from the support frame, imposing an oppositely longitudinally directed pulling force upon the cable toward the support frame. In a preferred embodiment the winch and traction cable combination is powered by an electric motor, and such winch is capable of exerting up to at least one thousand pounds of pulling force against the cable. A hydraulic motor may be suitably alternatively utilized. A hand crank driven winch may also be suitably alternatively utilized.

A further structural component of the instant inventive assembly comprises an anchoring assembly which attaches the winch and traction cable combination to the support frame. The anchoring assembly necessarily comprises an elastically deformable link or load cell which is adapted to include an attached electronic strain gauge. Where the winch's cable extends in the longitudinal direction and pulls toward the support frame in an oppositely longitudinal direction, the elastically deformable link or load cell is preferably attached oppositely longitudinally from an oppositely longitudinal end of the winch. Anchoring of the oppositely longitudinal end of the load cell on or with respect to the support frame allows the pulling force exerted by the winch to translate from the winch to the support frame via the load cell.

In a preferred embodiment, a strain gauge component of the load cell comprises a thin metal foil element having a pair of electrodes, such metal foil element elastically deforming with the winch pull induced elastic deformation of the load cell. During the strain gauge's elastic deformation, both the thickness geometry of the strain gauge and its electric resistance varies in direct proportion with changes to the pulling force exerted against the load cell. Where a constant voltage is applied across the strain gauge's electrodes, amperage or current varies in direct proportion with the changes in resistance, with the elastic deformation, and with the pulling force. Upon application of a constant amperage or current between the strain gauge's electrodes, voltage or electrical potential difference between the electrodes similarly varies in direct proportion with the elastic deformations of the strain gauge and the load cell, with the resultant change in resistance, and with the pulling force.

In a preferred embodiment an electronic strain meter is electrically connected to the strain gauge for displaying in terms of pounds of force or Newtons the tension applied by the winch to its traction cable.

A further structural component of the instant inventive assembly comprises means for mounting the support frame (and all of its attached and supported components as described above) to a towing vehicle such as a tractor or a pickup truck. Where the support frame constitutes a load bed of a wheeled trailer, the vehicle mounting means may comprise an oppositely longitudinally extending towing tongue and a trailer hitch bracket or loop. Alternative towing vehicle mounting means may suitably comprise a three point hitch assembly for supporting the frame at the rear of a tractor. Alternatively, a receiver hitch assembly may support the frame at and upon a pick up truck's rear bumper.

In use of the inventive assembly, a rancher may utilize the inventive assembly to extend multiple barbed wire strands along the line or run of a fence to be constructed, and to successively pull the strands with accurately gauged tension of each strand.

Accordingly, objects of the instant invention include the provision of a mobile barbed wire fence pulling assembly which incorporates structures as described above, and which arranges those structures in relation to each other in the manners described above for performance of the beneficial functions described above.

Other and further objects, benefits, and advantages of the instant invention will become known to those skilled in the art upon review of the Detailed Description which follows, and upon review of the appended drawings.

DETAILED DESCRIPTION OF THE INVENTION

Figure 1:
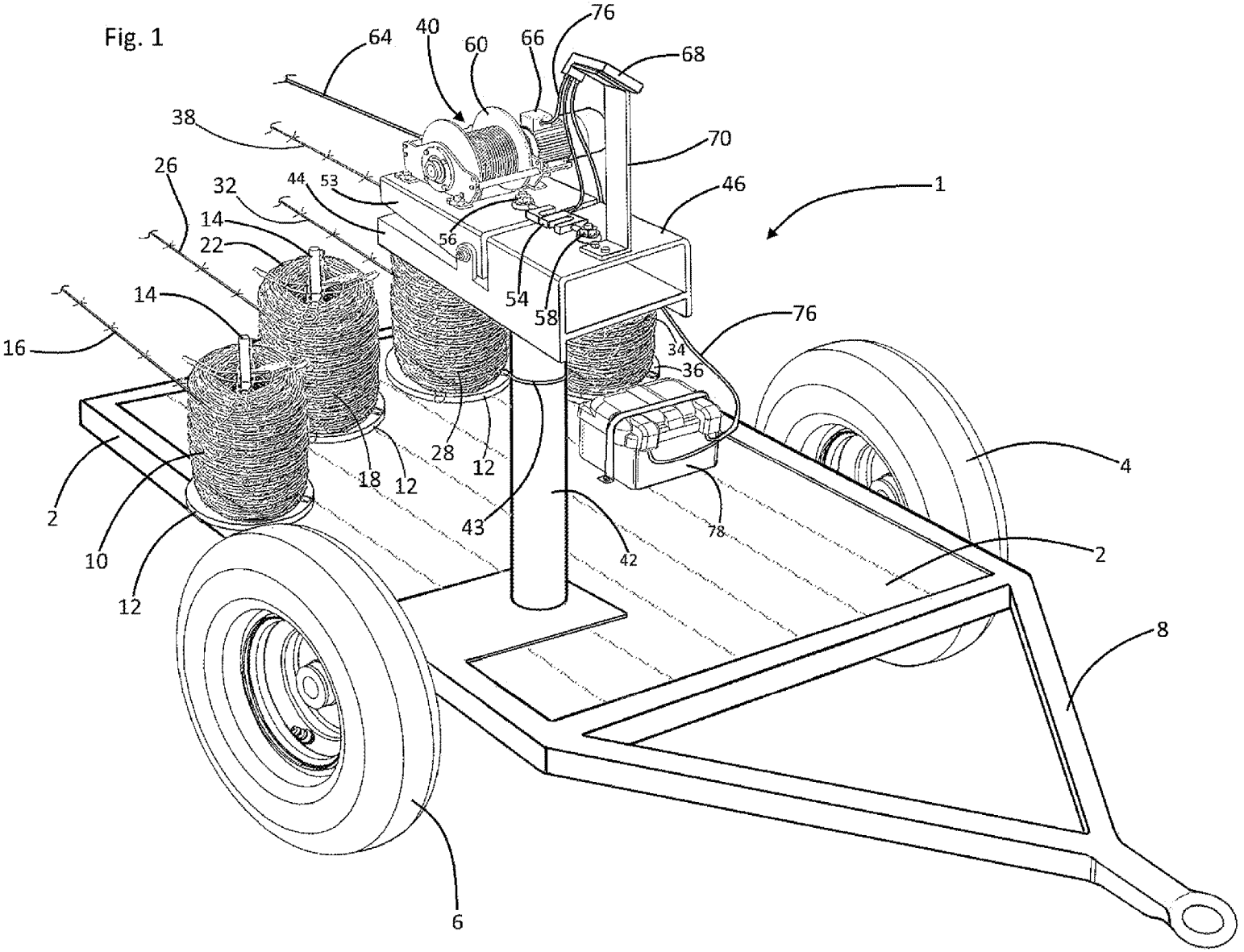
FIG. 1 is a perspective view of a preferred embodiment of the instant inventive mobile barbed wire fence pulling assembly.

Referring now to the drawings, and in particular to drawing FIG. 1, a suitable embodiment of the instant inventive mobile or vehicle carriable barbed wire fence pulling assembly is referred to generally by reference arrow 1. In the depicted embodiment, a support frame component 2 comprises a rectangular and horizontally extending weldment of square tube or L-flange beams, such frame 2 supporting a floor panel or a matrix of floor boards. The support frame 2 is suitably configured as a load bed of a wheeled trailer having left and right wheels 4 and 6, having an oppositely longitudinally extending towing tongue 8, and having a tow hitch 9.

A plurality of spindles 14 is fixedly mounted upon the support frame 2. In a preferred embodiment, the spindles 14 are rotatably mounted, each including a rotating base plates 12. Spools of barbed wire 10, 18, 28, and 34 are mounted over the spindles 14 to respectively rest upon the upper surfaces of the rotating base plates 12. Upon longitudinal dispensation and extensions of the spools' barbed wire strands 16, 26, 32, and 38, the spools 10, 18, 28, and 34 rotate with the base plates 12 about the spindles' vertical axes.

A further structural component of the instant inventive assembly comprises a winch and traction cable combination which is referred to generally by reference arrow 40. Such combination suitably comprises a rotary spool type winch 60 which stores, deploys, and forcefully retracts and draws a traction cable 64. Motor means are preferably provided for turning the winch 60, the motor means preferably comprising an electric motor 66. In a suitable alternate embodiment, the motor means may comprise a hydraulic motor (not depicted within views) powered by a hydraulic power system mounted upon the vehicle.

The winch and traction cable combination 60, 64, 66 is preferably fixedly mounted at a position overlying the support frame 2. In operation of such combination, upon a longitudinal extension of the traction cable 64, and upon actuation of the electric motor 66 to turn the winch spool 60, a pulling force is applied to the traction cable 64. As the winch's pulling force draws the cable 64 in the oppositely longitudinal direction toward the support frame 2, the winch progressively spools and stores the cable.

Figure 2:
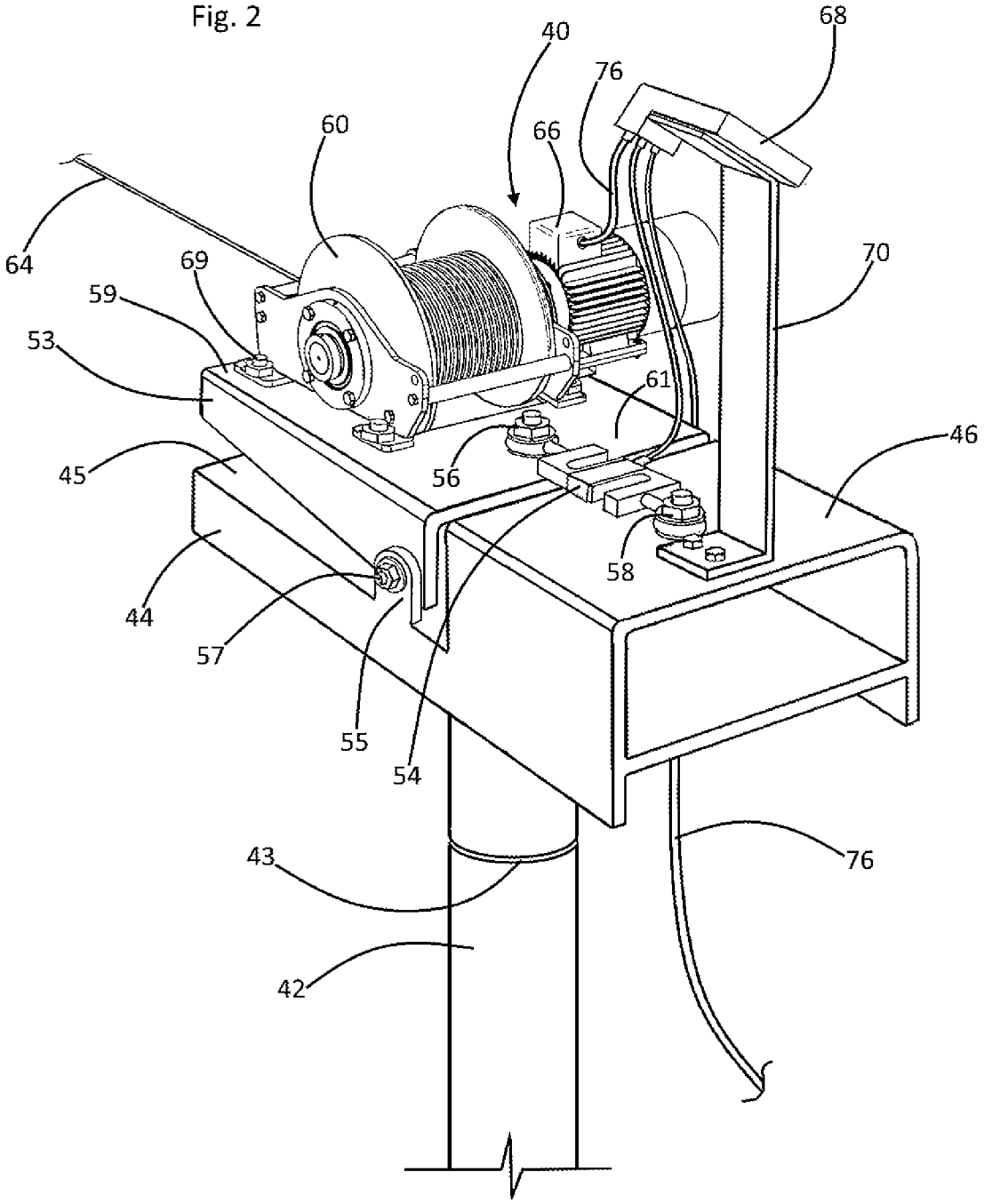
FIG. 2 is a magnified view of a portion of the structure depicted in FIG. 1.

A further structural component of the instant inventive assembly comprises an anchoring assembly which attaches and securely interconnects an oppositely longitudinal end or side of the winch and cable combination 60, 64, 66 to the support frame 2. In the preferred embodiment, the anchoring assembly performs a function of translating the winch's pulling force to the support frame. Referring simultaneously to FIGS. 1 and 2, the anchoring assembly comprises an elastically deformable link 54, such link preferably comprising an "S" type electronic load cell. Such load cell is suitably composed of aluminum or steel and has a surface mounted electronic strain gauge.

The load cell's strain gauge is suitably composed of thin strips of electrically conductive foil having a pair of electrode contacts. As the load cell elastically deforms under tension, the attached strain gauge foil correspondingly deforms, lengthening in the direction of the tension and thinning in a direction normal to the tension. Such dimensional thinning increases the electrical resistance between the foil's electrode contacts. Such dimensional thinning and increase in electrical resistance is directly proportional both to the elastic deformation of the load cell and the tension which induces the elastic deformation. Where a voltage applied across the strain gauge's electrode contacts is held constant, amperage or current within a circuit including the strain gauge varies in direct proportion with both the elastic deformation and the tension producing the deformation. Alternatively, where the amperage or current of a circuit including the strain gauge is held constant, voltage across the gauge's electric terminals varies directly proportionally with the tension which produces the elastic deformation. In the instant invention, an electronic strain meter 68 is connected by wiring matrix 76 to the strain gauge load cell 54. The strain meter operatively displays the magnitude in Newtons or pounds of tension upon cable 64 via voltage and/or amperage signals emanating from the strain gauge load cell 54. In the preferred embodiment, such load cell 54 is an "S" type load cell.

Further preferred components of the instant invention's anchoring assembly comprise a vertically extending post or column 42 which is fixedly and rigidly attached to the support frame 2. In a preferred embodiment, the column 42 incorporates a swivel joint 43 which allows the cable 64 extending from the winch to conveniently extend in various selected directions with respect to the column 42.

The anchoring assembly suitably further comprises a table 46 which is fixedly attached to or rigidly welded at an upper end of the column 42. In order to allow the anchoring assembly to mechanically attach and interconnect the support frame 2 with the winch and cable combination 60, 64, 66, the table 46 suitably includes a longitudinal extension 44 which attaches to and pivotally supports a pivoting proximal end of a bracket 53. In the depicted suitable embodiment, the bracket 53 is configured as an inverted "U" member who's left and right arms or flanges extend proximally or downwardly from a horizontally extending upper web. The distal or upper horizontally extending web of such bracket has a longitudinal end 59 and an oppositely longitudinal end 61, and the winch and cable combination 60, 64, 66 is fixedly mounted by nut and bolt fasteners 69 to the longitudinal end of such distal web. The proximal ends of the bracket's left and right flanges are pivotally supported by left and right pivot mounts 55 which receive laterally extending pivot facilitating axle bolts 57.

The longitudinal end of the elastically deformable link or load cell 54 is fixedly attached to the oppositely longitudinal end of the pivot bracket's distal web by means of a nut and bolt fastener 56. Correspondingly, the oppositely longitudinal end of the load cell 54 is attached to table 46 by another nut and bolt fastener 58. Accordingly, the interconnected components of the anchoring assembly operatively translate pulling forces from the traction cable 64 to the frame 2 via the winch 60 which spools the cable 64, fastening bolts 69 which mount the winch 60 upon the longitudinal end of the distal web of bracket 53, nut and bolt 56 fastener which attaches the longitudinal end of the load cell 54 to the oppositely longitudinal end of such bracket web, the elastically deformable link or load cell 54, nut and bolt fastener 58 which attaches the oppositely longitudinal end of the load cell 54 to table 46, a welded attachment of the table 46 to the upper end of support post 42, and a welded attachment of the lower end of post 42 to the support frame 2. In a preferred embodiment the longitudinal extension of the cable 54 is substantially collinear with the longitudinal dimension of the load cell 54 so that pulling forces applied by the motor 66 to the winch 60 substantially align with the load cell 54.

In a suitable embodiment, the longitudinal end 44 of the table 46 extends longitudinally to underlie the longitudinal end of the pivot bracket 53. The left and right arms or flanges of the bracket suitably slope upwardly toward their longitudinal ends to form and provide a pivot motion facilitating gap 45. Upon disconnecting and removing the load cell 54, the pivot bracket 53 and attached winch 60, 66 freely pivots slightly downwardly to rest and stop against the upper surface of the longitudinal end 44 of the table 46.

In the depicted suitable embodiment, the strain meter 68 is connected electrically by the matrix of electrically conductive wires 76 to the load cell 54, such strain meter being supported by a control support bracket 70. In operation, the strain meter 68 continuously displays the magnitude in Newtons or pounds of pulling forces exerted by the winch 60, 66 against the traction cable 64. In a suitable embodiment, a twelve volt battery 78 mounted upon the support frame 2 provides electric power to both the strain meter 68 and to the electric motor 66. Operation of the winch is preferably controlled via user inputs at the display face of the strain meter 68.

Figure 3:
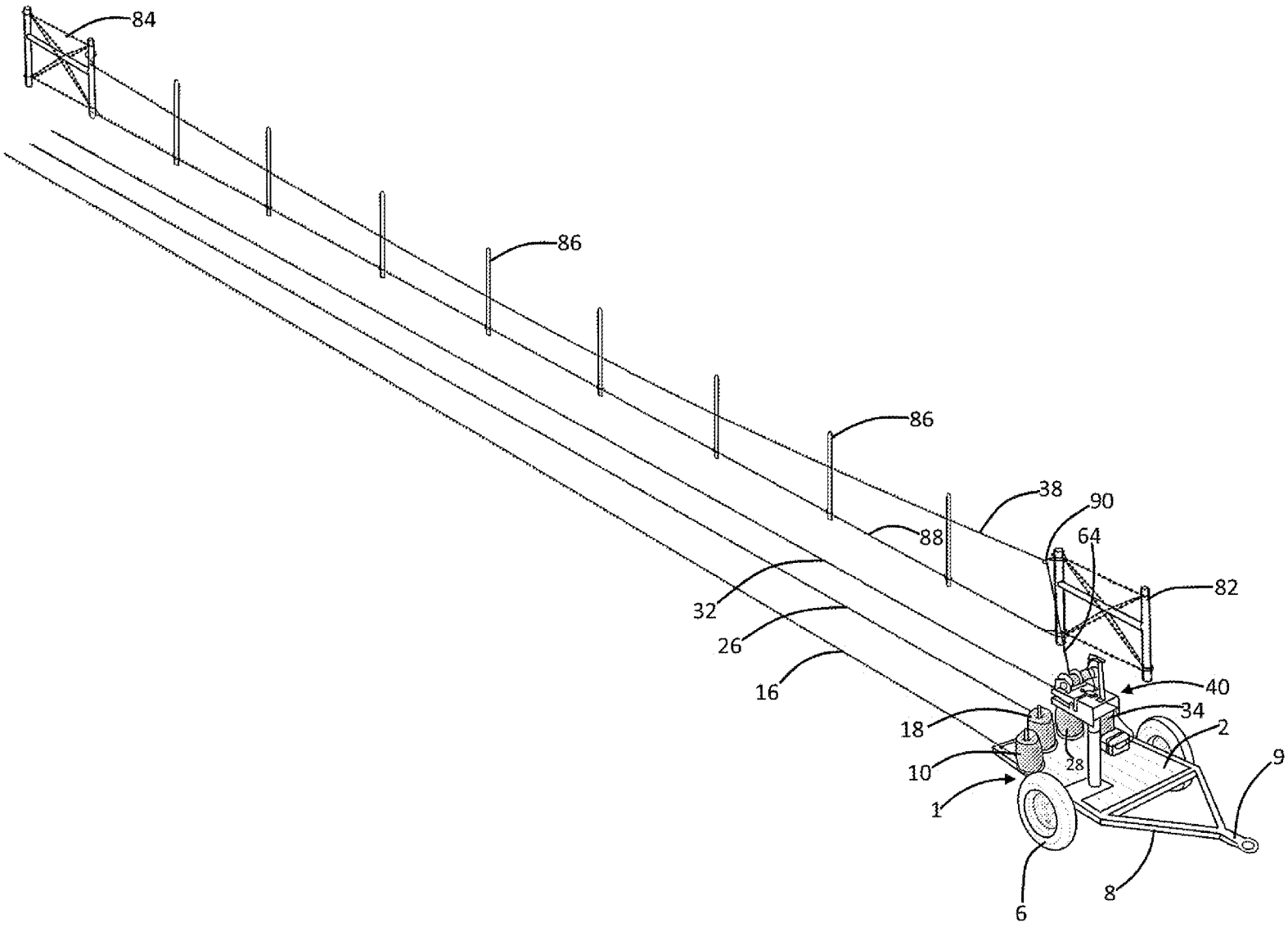
FIG. 3 is a diagram showing utilization of the instant inventive assembly in the construction of a five strand barbed wire fence.

In use of the instant inventive assembly 1, referring to FIGS. 1-3, a rancher may preliminarily set fence anchoring H-posts 82 and 84 at longitudinal and oppositely longitudinal ends of a five strand barbed wire fence to be constructed. Thereafter, the rancher may extend and stretch a ground wire or lowermost wire shroud 88 between lower ends of the H-posts 82 and 84. Thereafter, T-posts 86 may be driven into the ground at regular intervals of ten to twelve feet between H-posts 82 and 84. Thereafter, clips may be applied to securely attach such lower strand 88 to the T-posts 86.

Thereafter, the trailer 1 may be positioned adjacent to the longitudinal H-post 82. Thereafter, an upper barbed wire strand 38 from the trailer's leftmost spool 34 may be attached at an uppermost attachment point upon the longitudinal H-post 82. Thereafter, barbed wire strands 32, 26, and 16 may be extended from spools 28, 18, and 10 along the ground. Thereafter, the trailer may be towed by a vehicle (not depicted within views) oppositely longitudinally along the T-posts 86 the full length of the fence run. During such motion of the trailer 1, strands 38, 32, 26 and 16 progressively extend along the ground. Thereafter, the traction cable 64 may be extended through a pulley 90 attached to H-post 84, and the oppositely longitudinal end of strand 38 may be attached to traction cable 64. Thereafter, the winch 60, 66 may be operated to apply pulling tension to the traction cable 64 and to the upper barbed wire strand 38.

During stretching of the uppermost strand 38, the load cell 54 continuously provides tension indicating output signals to the strain meter 68. The tension of the stretched wire 38 is continuously displayed by the strain meter 68, suitably in terms of pounds of force. While utilizing the assembly for stretching such barbed wire, the rancher may initially apply a pulling force of approximately six hundred pounds and may thereafter reduce such pulling force to approximately two hundred fifty pounds, such heightened initial pulling force reducing tendencies of the barbed wire to progressively slacken over time. Following utilization of the instant inventive assembly to stretch the uppermost wire 38, clips may be applied to secure such wire at the uppermost positions upon the T-post 86.

Thereafter, the remaining barbed wire strands 32, 26, and 16 may be successively tied to the longitudinal H-post 82 and may be stretched and fastened in the same manner as described above with reference to the uppermost barbed wire strand 38. Following attaching, stretching, tying, and fence post clipping of the final barbed wire strand 16, the assembly of the barbed wire fence depicted in FIG. 3 is completed.

Figure 4:
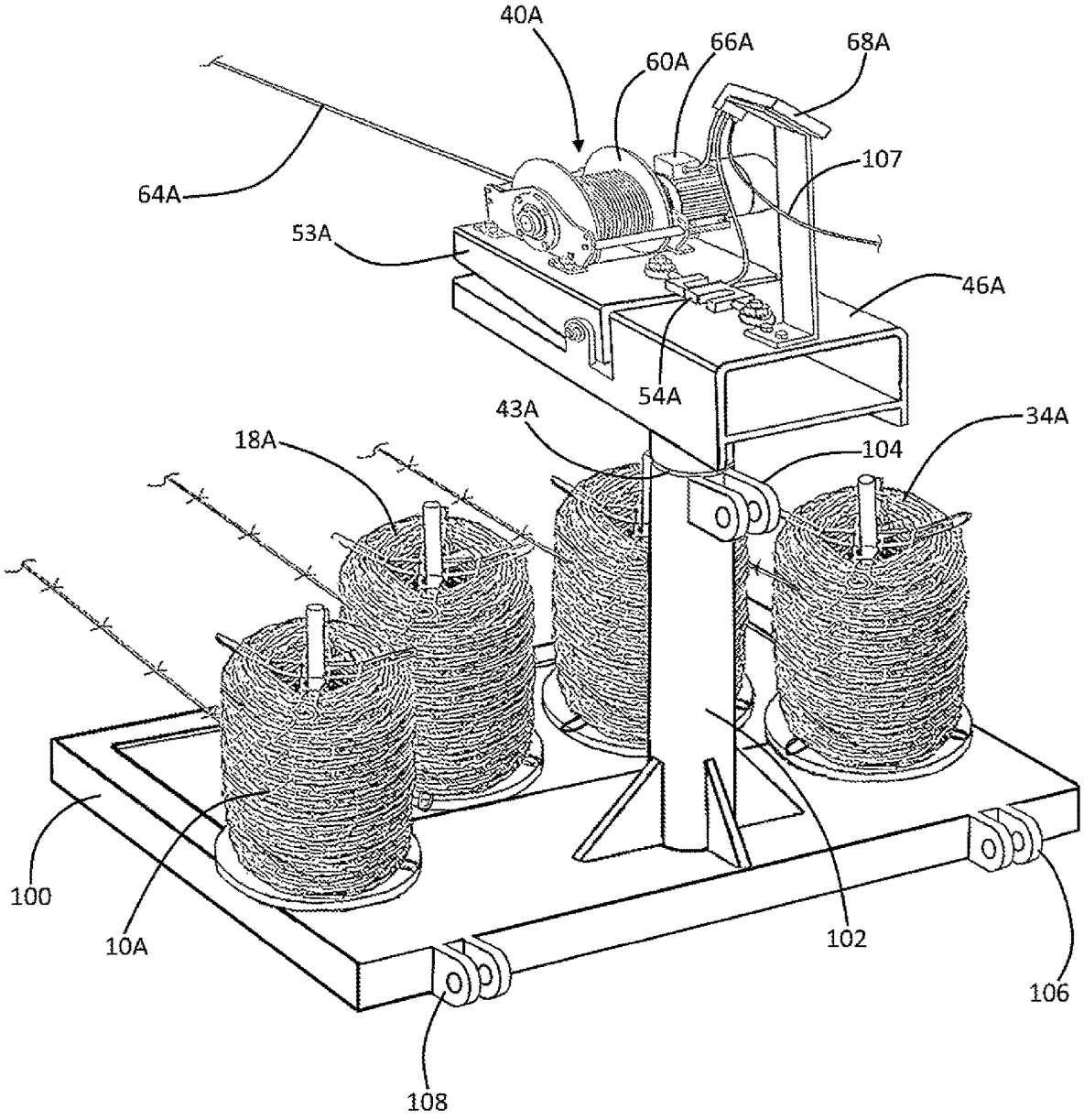
FIG. 4 presents an alternative configuration of the assembly of FIG. 1.
Figure 5:
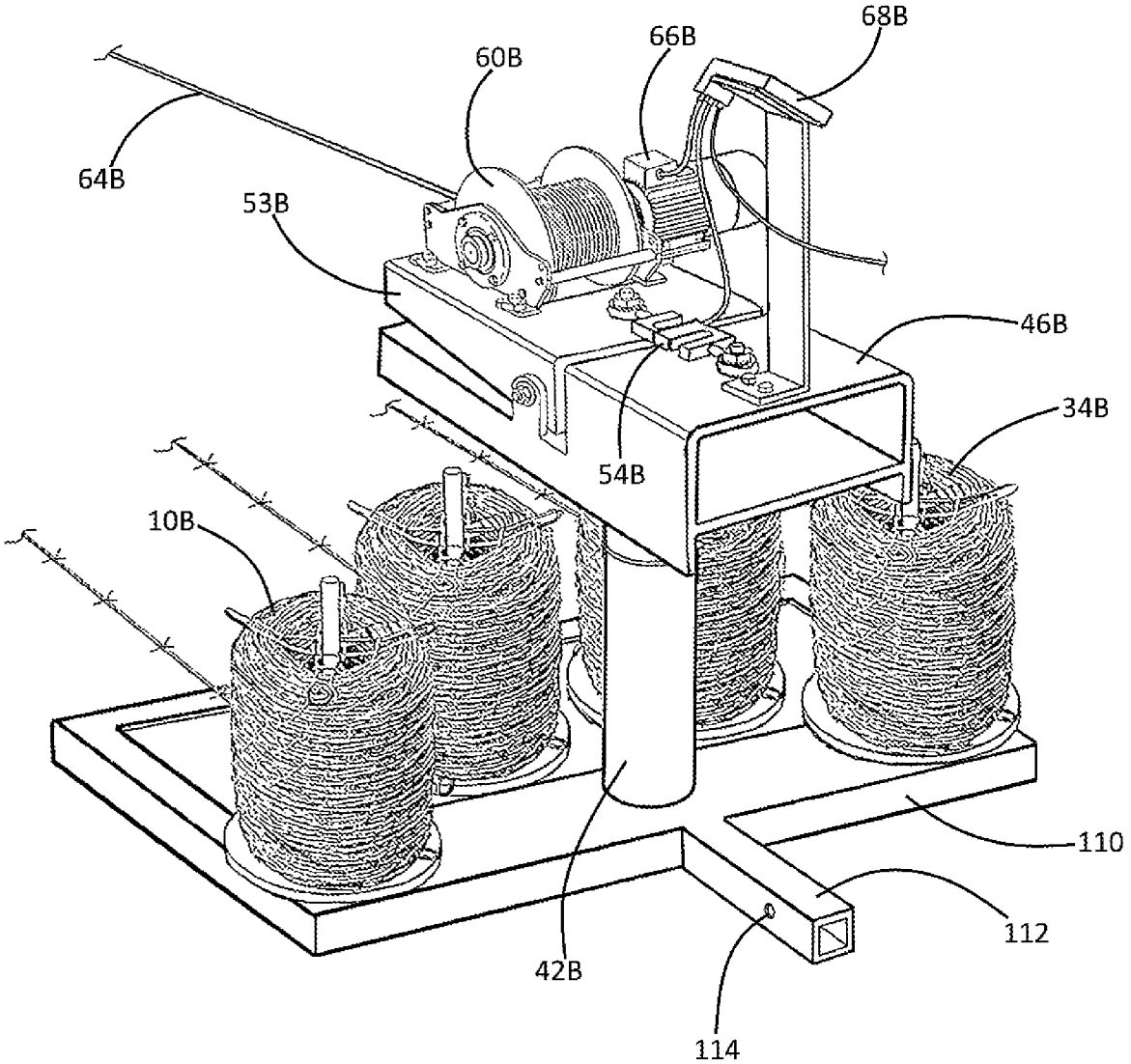
FIG. 5 presents a further alternative configuration of the assembly of FIG. 1.

Referring simultaneously to FIGS. 1, 2, 3, and 4, all structures identified in FIG. 4 by a reference numeral having a suffix "A" are configured similarly with similarly numbered structures appearing in FIGS. 1-3. In the FIG. 4 structural alternative, the wheeled trailer configuration of the support frame 2 of FIG. 1 is eliminated, and a non-wheeled support frame 100 is provided. Such alternative support frame 100 presents tractor three-point hitch mounting components including left and right clevis mounts 106 and 108, a central post 102, and a central clevis mount 104 at the upper end of such post. In the FIG. 4 alternative configuration, the central three point hitch post 102 dually or simultaneously functions as a winch support member.

The FIG. 4 configuration of the instant inventive assembly may be easily and conveniently attached to the rear three-point hitch arms of an agricultural common tractor. In the FIG. 4 configuration, electrical power may be supplied via conductor 107 which extends to and connects with the tractor's electric power system. In the FIG. 4 configuration, hydraulic power from the tractor's rear implement hydraulic power system may be alternatively utilized for turning the winch 60A.

The triple of clevises 104, 106, and 108, in addition to their three-point hitch attaching functions, are intended as being representative of a quadruple of similarly configured clevises which may mount frame 100 upon the lift arms and bucket rams of a common front loader tractor or skid steer loader. In such alternative vehicle mounting means, right and left posts similar to post 102 may be provided for supporting a right upper clevis overlying clevis 108 and for supporting a left upper clevis overlying clevis 106. In such alternative vehicle mounting means, right and left clevises 106 and 108 would attach to the loader's right and left lift arms while such overlying post mounted clevises would attach to the loader's bucket rams. Such quadruple of clevises may alternatively be mounted upon a rectangular frame (not depicted in views) fixedly attached to and extending upwardly from the oppositely longitudinal end of frame 100.

Referring simultaneously to FIGS. 1-3 and 5, all structures identified by a reference numeral having the suffix "B" are configured similarly with similarly numbered structures appearing in FIGS. 1-3. In the FIG. 5 alternative configuration, a receiver hitch mount 112 supports frame 110. A common receiver hitch socket mounted beneath the bumper of a pickup truck may receive hitch shaft 112. Thereafter, a lock pin may extend transversely through pin receiving eye 114.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A vehicle carriable barbed wire fence pulling assembly comprising:

a. A support frame;

b. A plurality of spindles, each spindle being mounted upon the support frame, said each spindle being adapted for receiving a barbed wire spool;

c. A winch and traction cable combination overlying the support frame, said combination being adapted for, upon a longitudinal extension of said combination's traction cable from the support frame, pulling said cable oppositely longitudinally;

d. An anchoring assembly attaching an oppositely longitudinal end of the winch and traction cable combination to the support frame, the anchoring assembly comprising an elastically deformable link adapted for oppositely longitudinally translating said cable pull;

e. An electronic strain gauge fixedly attached to the elastically deformable link;

f. A strain meter electrically connected to the electronic strain gauge, the strain meter being adapted for displaying a magnitude of said cable pull; and g. Means for attaching the support frame to the vehicle.

2. The vehicle carriable barbed wire fence pulling assembly of claim 1 wherein the strain gauge comprises an electrically conductive foil element having a pair of electrodes.

3. The vehicle carriable barbed wire fence pulling assembly of claim 2 wherein the elastically deformed link comprises a load cell.

4. The vehicle carriable barbed wire fence pulling assembly of claim 3 wherein the load cell comprises and "S" type load cell.

5. The vehicle carriable barbed wire fence pulling assembly of claim 3 wherein the anchoring assembly comprises a support post extending from the support frame, and wherein an oppositely longitudinal end of the load cell is fixedly anchored at an upper end of the support post.

6. The vehicle carriable barbed wire fence pulling assembly of claim 5 where the anchoring assembly further comprises a bracket having proximal and distal ends, wherein the proximal end of the bracket is pivotally mounted at the support post's upper end, wherein a longitudinal end of the load cell is anchored upon the distal end of the bracket, and wherein the winch and cable combination is mounted upon the distal end of the bracket.

7. The vehicle carriable barbed wire fence pulling assembly of claim 6 wherein the distal end of the bracket has longitudinal and oppositely longitudinal ends, and wherein the longitudinal end of the load cell is further anchored at the oppositely longitudinal end of the bracket's distal end.

8. The vehicle carriable barbed wire fence pulling assembly of claim 7 wherein the winch and traction cable combination is positioned at the longitudinal end of the pivot bracket's distal end.

9. The vehicle carriable barbed wire fence pulling assembly of claim 1 further comprising motor means connected operatively to the winch and traction cable combination's winch, said means being adapted for actuating the cable pull.

10. The vehicle carriable barbed wire fence pulling assembly of claim 9 wherein the motor means comprise an electric motor.

11. The vehicle carriable barbed wire fence pulling assembly of claim 10 wherein the means for mounting the support frame upon the traction vehicle comprise a towing implement selected from the group consisting of trailer hitches; tractor three point hitch assemblies; rear bumper receiver hitches; and front loader mounts.

12. The vehicle carriable barbed wire fence pulling assembly of claim 1 comprising a wheeled trailer having a load bed and a towing tongue, wherein the support frame comprises the load bed, and wherein the means for mounting the support frame upon the traction vehicle comprise the towing tongue.

13. The vehicle carriable barbed wire fence pulling assembly of claim 12 wherein the winch and traction cable combination's winch comprises an electric motor driven winch.

14. The vehicle carriable barbed wire fence pulling assembly of claim 13 further comprising an electric storage battery mounted upon the load bed, said battery being electrically connected to the electric motor driven winch.

15. The vehicle carriable barbed wire fence pulling assembly of claim 14 wherein the strain meter is further electrically connected to the electric storage battery.

* * * * *